US005553586A

United States Patent [19]

Koishikawa et al.

[11] Patent Number: 5,553,586

[45] Date of Patent: Sep. 10, 1996

[54] ENGINE AND OUTBOARD ENGINE STRUCTURE

[75] Inventors: Kouji Koishikawa; Masaki Tsunoda; Hitoshi Suzuki, all of Wako, Japan

[73] Assignee: Honda Giken Kogyo Kabushiki Kaisha, Tokyo, Japan

[21] Appl. No.: 357,513

[22] Filed: Dec. 16, 1994

[30] Foreign Application Priority Data

| | | | |
|---|---|---|---|
| Dec. 18, 1993 | [JP] | Japan | 5-343907 |
| Dec. 18, 1993 | [JP] | Japan | 5-343908 |
| Dec. 18, 1993 | [JP] | Japan | 5-343909 |

[51] Int. Cl.[6] ..... F02F 7/00

[52] U.S. Cl. ..... 123/195 P; 123/54.4; 123/184.34; 123/196 W; 440/900

[58] Field of Search ..... 123/184.24, 184.25, 123/184.31, 184.32, 184.34, 195 P, 196 W, 54.4, 54.6, 54.7, 54.8; 440/88, 89, 900

[56] References Cited

U.S. PATENT DOCUMENTS

| | | | |
|---|---|---|---|
| 3,973,548 | 8/1976 | Celli | 123/195 R |
| 4,787,342 | 11/1988 | Matsumori et al. | 123/54.6 |
| 4,907,551 | 3/1990 | Sakono et al. | 123/196 R |
| 5,231,958 | 8/1993 | Takahashi et al. | 123/73 A |
| 5,309,877 | 5/1994 | Shigedomi et al. | 123/195 P |
| 5,388,555 | 2/1995 | Shiomi et al. | 123/195 P |

FOREIGN PATENT DOCUMENTS

| | | | |
|---|---|---|---|
| 151209 | 9/1920 | United Kingdom | 123/54.8 |

OTHER PUBLICATIONS

Patent Abstracts of Japan, vol. 12, No. 400 (M-756), Oct. 24, 1988 & JP-A-63 143332, Jun. 15, 1988.

Patent Abstracts of Japan, vol. 12, No. 208 (M-709), Jun. 15, 1988 & JP-A-63 012873, Jan. 20, 1988.

*Primary Examiner*—Noah P. Kamen

*Attorney, Agent, or Firm*—Nikaido Marmelstein Murray & Oram LLP

[57] ABSTRACT

A plurality of cylinders are defined in a single cylinder block, and a single cylinder head common to the cylinders is mounted on the cylinder block. Exhaust passages are provided in the cylinder head at a location corresponding to an inner side and central portion of a V-shape formed by the cylinders, the exhaust passages communicating with the cylinders, respectively. Intake passages are provided in the cylinder head at a location corresponding to opposite outside positions of the V-shape, the intake passages communicating with the cylinders, respectively. The intake passages open into a side of the cylinder head on opposite sides of the V-shape, and fuel injection nozzles provided in the intake passages, respectively. The exhaust passage extend parallel to a crankshaft within the cylinder head and open into the corresponding side of the cylinder head. A water jacket is defined around the exhaust passages to surround the exhaust passages.

17 Claims, 9 Drawing Sheets

ENGINE AND OUTBOARD ENGINE STRUCTURE

BACKGROUND OF THE INVENTION

1. Field of the Invention

The present invention relates to an engine of relatively small size for use, for example, as an engine for an outboard engine structure. The present invention further relates to an outboard engine structure having a small engine.

2. Description of the Prior Art

An outboard engine is disclosed, for example, in Japanese Patent Application Laid-open No. 267561/87. This engine includes a crankshaft disposed vertically, and two banks of cylinders disposed in an opposed V-shaped configuration. Each of the banks includes a cylinder block having three horizontal cylinders disposed in line along an axis of the crankshaft, and a cylinder head secured to an end face of the cylinder block in an axial direction of the cylinders.

Intake ports are located on the inner sides of the V-shaped banks. Intake pipes connected to the intake ports extend in a direction away from the crankshaft at least partially along a center line of the angle of the V formed between the banks. A multi-barrel, single-chamber carburetor is provided for every pair of opposed cylinders.

Exhaust ports are located on the outer sides of the banks. Exhaust passages connected to the exhaust ports, extend toward the crankshaft at least partially along the axes of the cylinders, and then extend to meet together in a single exhaust pipe.

In such a prior art engine, an intake system including the intake pipes and carburetors, is disposed on the inner side of the V-shaped banks. Therefore, it is difficult to reduce the angle formed between the banks arranged in the V-shape for decreasing the width of the engine, to thereby reduce the size of the engine.

Further, to reduce the angle of the V between the banks, the carburetor would have to protrude away from the crankshaft. This results in the problem that the length of the engine is increased, and the center of gravity of the engine itself is correspondingly displaced in a direction away from a crank chamber, which is not preferred depending upon conditions.

There is another conventionally known multi-cylinder engine intake device. In such a device, the same number of intake pipes as that of cylinders extend from a surge tank having a predetermined capacity, and the intake pipes are connected to intake ports. A fuel injection device is disposed in each of the intake ports or in each of the intake pipes in the vicinity of the intake port, and a throttle valve is mounted on the surge tank for controlling the amount of air drawn into the tank.

Such an intake device is disclosed, for example, in Japanese Patent Application Laid-open No. 60024/93. This intake device is applied to an in-line 4-cylinder engine for an outboard engine structure, and includes a surge tank disposed on one of the sides of the engine body at a location close to a crankcase. Four intake pipes (the same number as that of cylinders) extend from the surge tank and are connected to intake ports in a cylinder head, respectively.

The upper three of the four intake pipes extend upwardly from the side of the surge tank and are then curved downwardly at their intermediate portions. The remaining lowermost intake pipe extends straight laterally and downwardly from a bottom of the surge tank. All of the intake pipes are disposed to extend along the side of the engine body.

In such an engine, all the intake pipes extend from the single surge tank, and the total amount of air drawn must be provided by the single surge tank. Hence, the capacity of the surge tank is necessarily increased.

As a result, if the capacity of the single surge tank is increased, it is difficult to accommodate the surge tank in an engine compartment in a compact manner.

Therefore, there is almost no space for disposition of auxiliaries around the engine, resulting in a decreased degree of freedom for selection of positions for the disposition of the auxiliaries.

SUMMARY OF THE INVENTION

Accordingly, it is an object of the present invention to reduce the angle formed by the V-shaped banks in an engine to thereby provide a reduction in size of the engine and at the same time to improve the intake system including the surge tank to provide a reduction in size of the engine, and further to improve an engine lubrication system including an oil pump to provide a reduction in size of the engine or outboard engine structure.

To achieve the above object, according to the present invention, there is provided an engine structure, comprising: a plurality of cylinders disposed in a V-shaped configuration toward a crankshaft, the cylinders being in a single cylinder block; and a cylinder head common to the cylinders, mounted on a head of the cylinder block. Exhaust passages which communicate with the cylinders, are provided in the cylinder head at a location corresponding to the inner sides and central portion of the V-shape formed by the cylinders and intake passages which communicate with the cylinders, are provided in the cylinder head at a location corresponding to opposite outside positions of the V-shape, the intake passages opening into a side surface of the cylinder head on the opposite sides of the V-shape. Fuel injection nozzles are provided in the intake passages, respectively.

With the above arrangement, the cylinders opposed to each other form the V-shape in the single cylinder block and it is possible to significantly reduce the angle formed by the opposed cylinders and to thereby reduce the width of the engine, and thus the entire size of the outboard engine structure having such an engine.

On the other hand, the relatively simple exhaust passages not requiring attachments such as a carburetor in an intake system, are provided on the inside and central locations in the cylinder head, and the intake passages open into the side of the cylinder head on the opposite sides of the V-shape. Therefore, it is also possible to significantly reduce the size of the cylinder head, so that the single cylinder head corresponds to the cylinder block. Moreover, the supply of fuel is performed by fuel injection nozzles and hence, it is unnecessary to connect a carburetor to each of the intake passages, thus further reducing the size of the entire engine.

Further, as a result of having the exhaust and intake passages in the cylinder head in the above-described manner, these passages for the cylinders are equalized in length with respect to one another and well-featured, which contributes to the enhancement of performance of the engine.

In addition, according to the present invention, the engine, comprises a plurality of cylinders; a plurality of intake pipes which communicate with the cylinders, respectively, and extend from a side of a cylinder head along a side surface of an engine body toward a crank chamber, the intake pipes being connected to surge tanks. The intake pipes are disposed such that they are located on opposite sides of the engine body, and the surge tanks are mounted on the opposite sides, so that air is supplied to the surge tanks through a throttle means disposed outside a central portion of the crankshaft chamber.

With the above arrangement, a relatively small number of the intake pipes corresponding to half the number of cylinders, are located on the opposite sides of the engine body and therefore, it is easy to position the intake pipes, and it is also easy to equalize the effective lengths of the intake pipes.

Each of the surge tanks mounted on the opposite sides of the engine body, may be of a relatively small capacity corresponding to half the total amount of air drawn and therefore, in cooperation with a decrease in number of the intake pipes, sufficient space for the location of auxiliaries is created on the opposite sides, leading to an increased degree of freedom for selecting the positions of the auxiliaries. Thus, a well-balanced engine can be provided by disposing the auxiliaries in a suitable distribution in these spaces.

In addition, since air is supplied through the single throttle means to the surge tanks and it is unnecessary to mount a flow rate adjusting device in each of the surge tanks, the surge tanks are further reduced in size and simplified in structure, leading to a reduced cost. Since the throttle means is mounted outside the central portion of the crankshaft chamber, i.e., on a lateral center line of the engine, a laterally symmetric and balanced intake device can be provided.

Further, according to the present invention, the engine comprises a crankshaft disposed vertically; a plurality of horizontal cylinders defined in a single cylinder block and divided into two groups defining a V-shape, such that the two groups of cylinders are opposed to each other and one group is disposed higher than the other group; and an oil pump disposed below the one group.

With the above arrangement, since the cylinders are in the single cylinder block and the pair of the cylinders opposed to each other to form the V-shape, are at a higher level than the other pair of cylinders, the angle formed between the opposed cylinders can be sufficiently reduced to reduce the size of the engine body. Since the oil pump is disposed below the space created below the cylinders disposed at the higher level, it is possible to provide an engine which is small in size and compact as a whole.

Still further, according to the present invention, there is provided an engine or an outboard engine structure having such an engine, comprising: a cylinder block supporting a vertical crankshaft; and a plurality of horizontal cylinders disposed in the cylinder block in a V-shaped configuration; wherein the engine further comprises intake pipes disposed along left and right side portions of the cylinder block, an oil filter disposed on one of the left and right side portions, and a throttle means disposed on an outer side of the central portion of the crankcase, coupled to the cylinder block.

With the above arrangement, it is possible to utilize the space along an outer periphery of the V-shaped cylinder block and an outer periphery of the crankcase coupled to the cylinder block, to reduce the size of the engine or the outboard engine structure having such an engine.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an engine for an outboard engine structure as a preferred embodiment with reference to the accompanying drawings.

Figure 1:
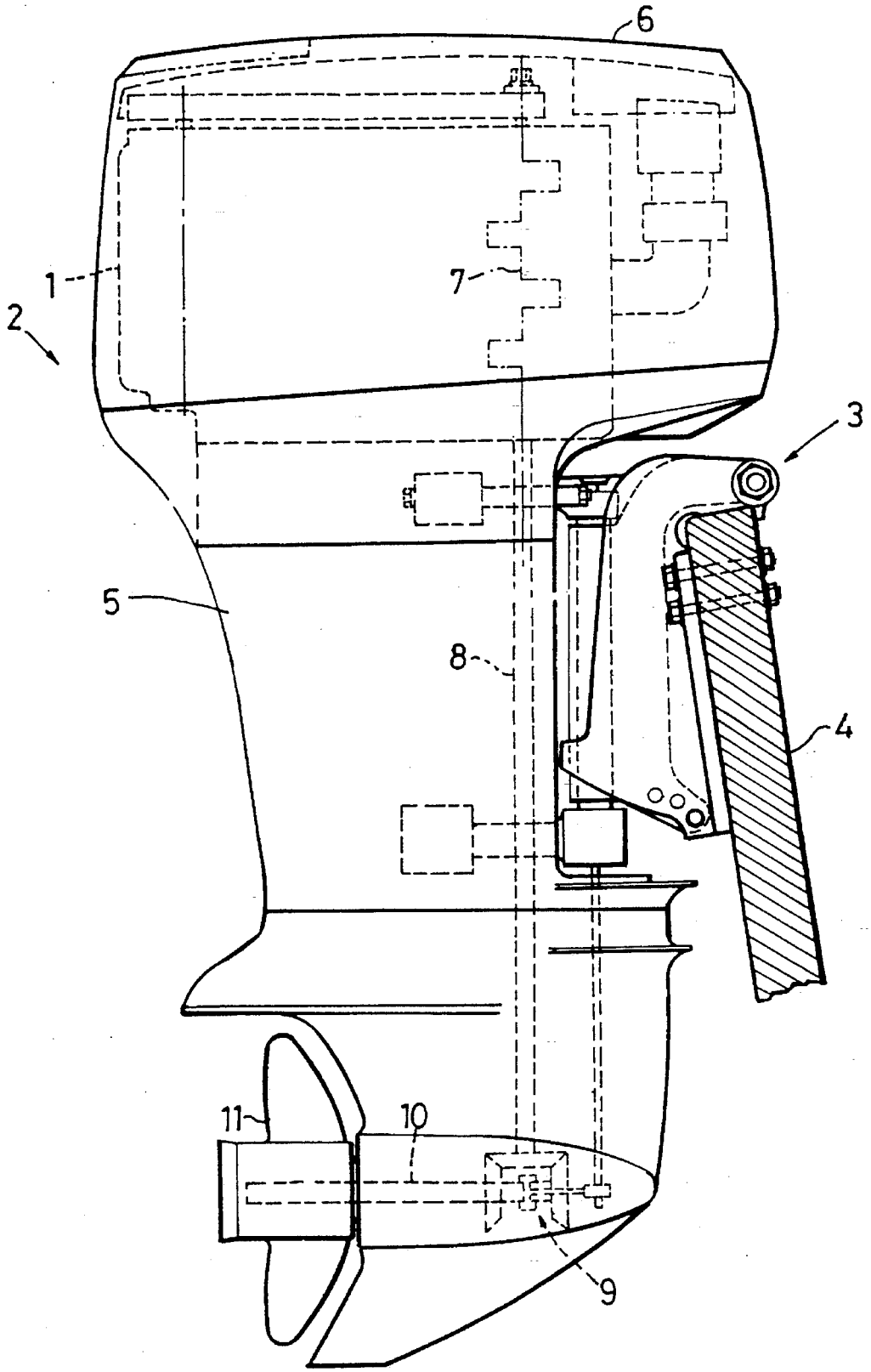
FIG. 1 is a side view of the entire engine to which the present invention is applied.

FIG. 1 is a side view of the entire outboard engine structure 2 including an engine 1 according to the present invention. The outboard engine structure 2 is mounted at the stern or rear board 4 of a boat or ship with a mounting fixture 3. A motor case 5 has a lower portion submerged in water. The engine 1 is mounted in an upper portion of the motor case 5 and covered at its upper portion by an engine cover 6.

The engine 1 will be described in detail hereinafter. A crankshaft 7 of the engine is oriented vertically, and a drive shaft 8 is connected to the crankshaft 7 and extends downwardly within the motor case 5. The drive shaft 8 is connected at its lower end to a propeller shaft 10 through a clutch and gear device 9 for moving the boat forward and backward. A propeller 11 is rotatably driven by engine power transmitted through the crankshaft 7, the drive shaft 8, the clutch and gear device 9 and the propeller shaft 10.

The terms "left" and "right" mean left and right when the outboard engine structure mounted at the stern 3 of the boat or ship as shown in FIG. 1, is viewed forwardly from rear (rightwardly from left in FIG. 1.)

Figure 2:
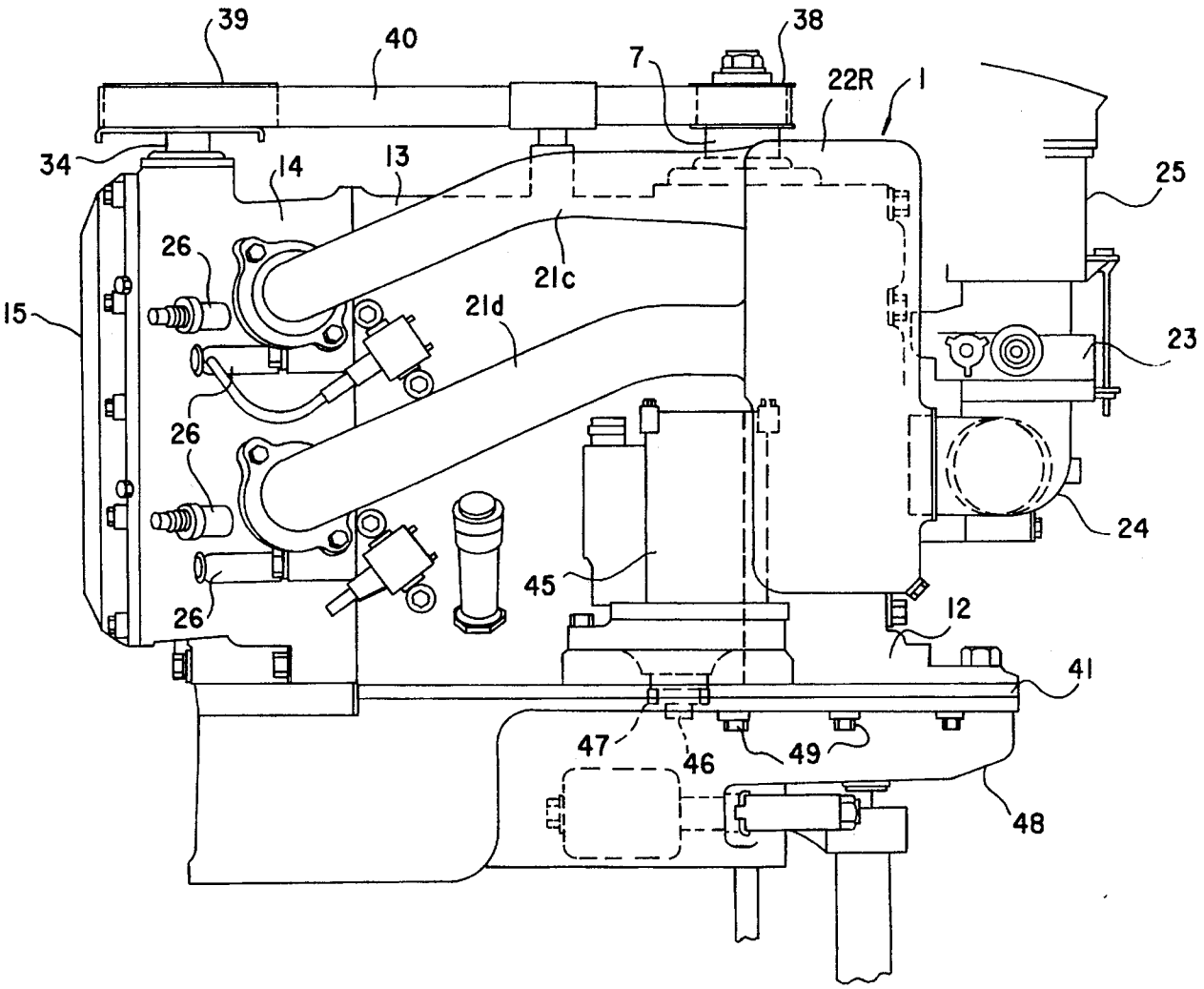
FIG. 2 is a right side view of the engine.
Figure 3:
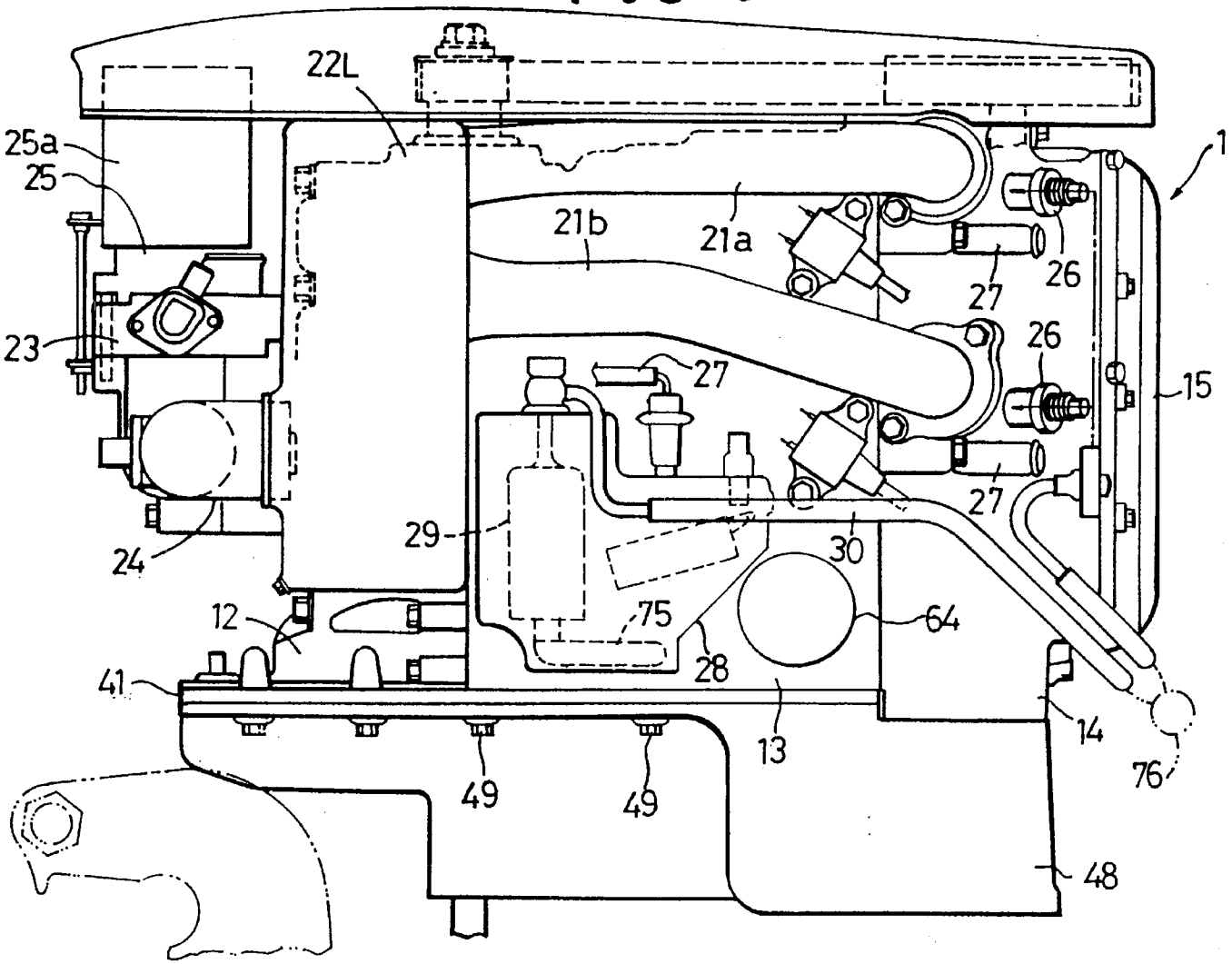
FIG. 3 is a left side view of the engine.
Figure 4:
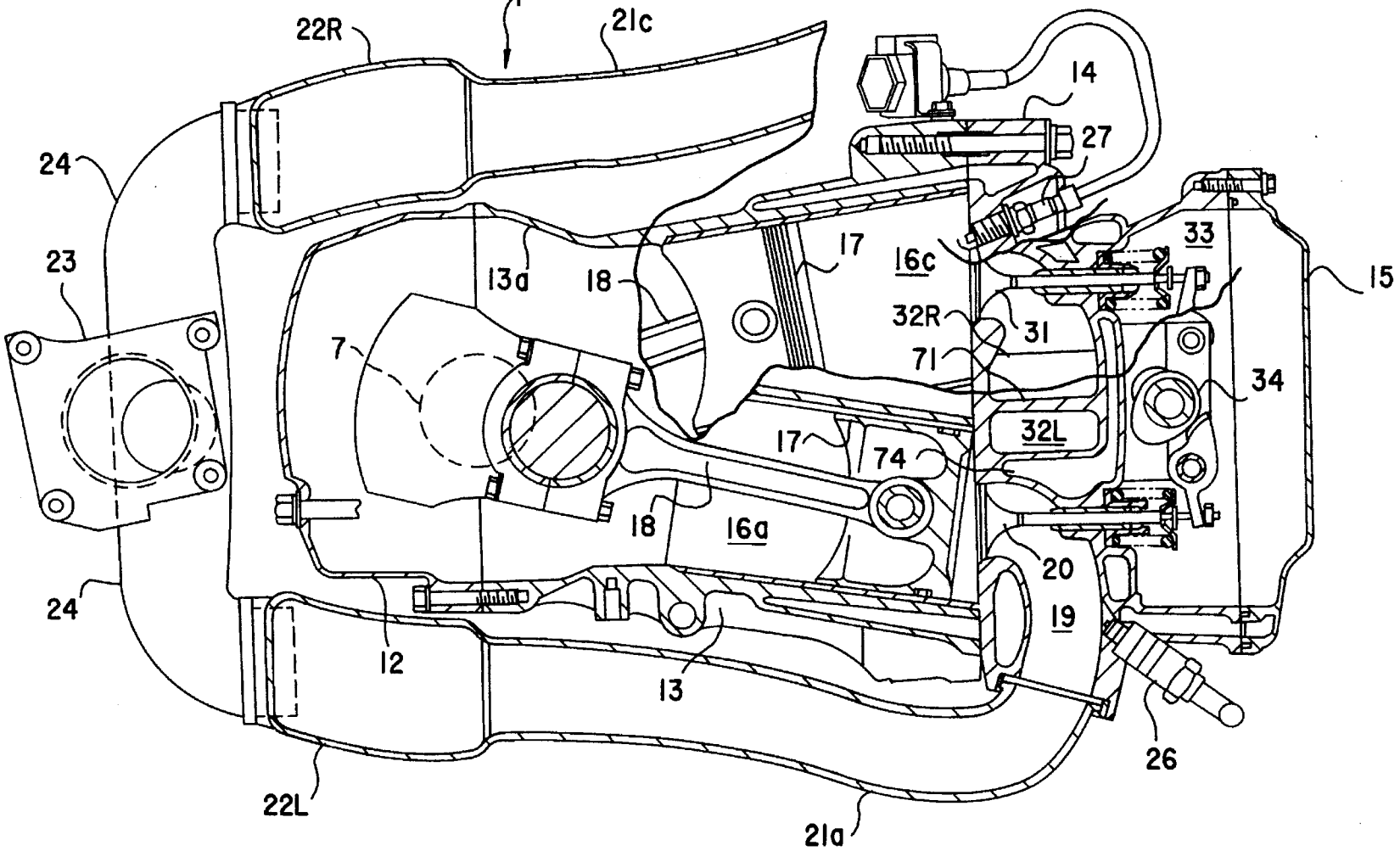
FIG. 4 is a cross-sectional view of the engine.

As shown in FIGS. 2 to 4, the body of the engine 1 comprises a crankcase 12, a cylinder block 13, a cylinder head 14 and a cylinder head cover 15. The cylinder block 13 is integrally provided with a skirt 13*a* which forms a portion of the crankcase 12, as shown in FIG. 4. Two sets of left and right cylinders 16*a*, 16*b*, 16*c* and 16*d* oriented horizontally are in a V-shaped configuration or arrangement in the cylinder block 13. Pistons 17 in the cylinders are connected to the single vertically oriented crankshaft 7 through connecting rods 18. Thus, the engine 1 is a V-type vertical engine.

Figure 5:
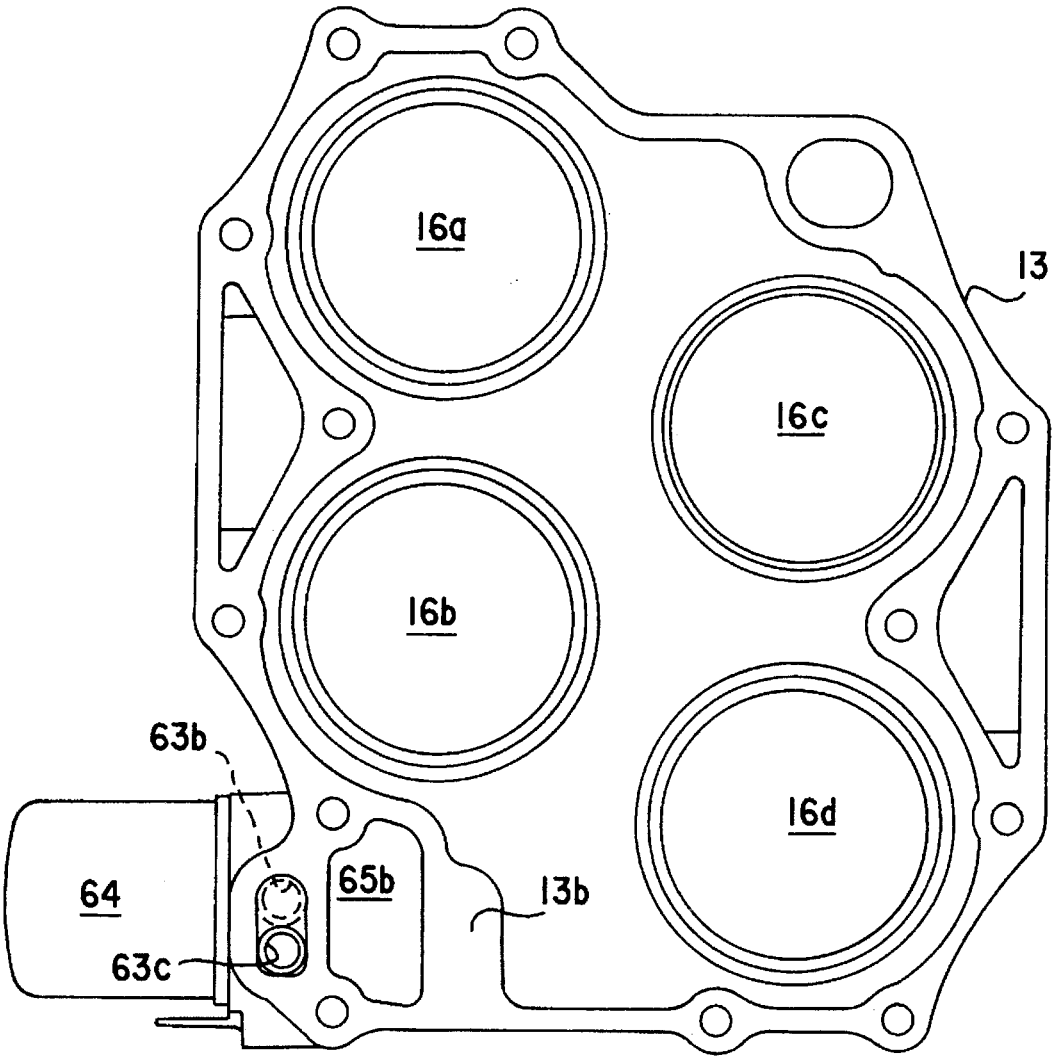
FIG. 5 is an end view of a cylinder block taken on the side of a cylinder head.

FIG. 5 is an end view of the cylinder block 13 taken on the side of the cylinder head 14. As can be seen from FIG. 5, the two sets of left and right cylinders 16*a* to 16*d* are four cylinders: a set of cylinders 16*a* and 16*b* arranged vertically on a left side, and another set of cylinders 16*c* and 16*d* arranged vertically on a right side. The cylinders are arranged in a zigzag manner with the left cylinders 16*a* and 16*b* being at a higher level than the right cylinders 16*c* and 16*d*. Such arrangement of the cylinders reduces the lateral width of the cylinder block 13 to thereby reduce the size of the engine 1.

Intake passages 19 are provided in the cylinder head 14 in correspondence to the cylinders 21. In FIG. 4, one of the intake passage 19 is shown for the lower cylinder 16*a*. The intake passages 19 lead to the corresponding cylinders 16*a* to 16*d* through intake valves 20 and open at the other end at sides of the cylinder head 14. Intake pipes 21*a*, 21*b*, 21*c* and 21*d* are connected to the openings of the intake passages 24, respectively, and extend forwardly along the side of the cylinder block 13. The intake pipes 21*c* and 21*d* shown in FIG. 2 are intake pipes corresponding to the cylinders 16*c* and 16*d* shown in FIG. 5, while the intake pipes 21*a* and 21*b* shown in FIG. 3 are intake pipes corresponding to the cylinders 16*a* and 16*b* shown in FIG. 5.

Surge tanks 22L and 22R are provided on the lateral opposite side areas of a front portion of the cylinder block 13. The intake pipes 21*a* and 21*b* are in communication with the surge tank 22L, while the intake pipes 21*c* and 21*d* are in communication with the surge tank 22R. A throttle body 23 having a throttle valve therein, is disposed on a front, central portion of the crankcase 12 and is in communication with the surge tanks 22L and 22R through an air passage 24 which diverges laterally from the throttle body 23.

Air is introduced from above through an air introducing pipe 25 into the throttle body 23, adjusted in flow rate within the throttle body 23, then distributed to the left and right surge tanks 22L and 22R and supplied as combustion air through the intake pipes 21*a* to 21*d* into the corresponding cylinders 16*a* to 16*d*. Fuel is injected from fuel injection nozzles 26 and mixed with the air in the intake passages 19. The air introduced from below into an air intake pipe 25*a* adjacent the air introducing pipe 25, is passed from above into the air introducing pipe 25 (FIG. 3).

The fuel is supplied from a fuel tank mounted on the ship or boat. Therefore, as shown in FIG. 3, a fuel supply system is disposed on a left portion of the cylinder block 13. This fuel supply system includes a fuel receiving pipe 127, a gas-liquid separator 28, a fuel pump 29, a fuel supply pipe 30, a strainer 75, and a high pressure filter 76 which are connected to the fuel tank mounted on the boat.

Figure 6:
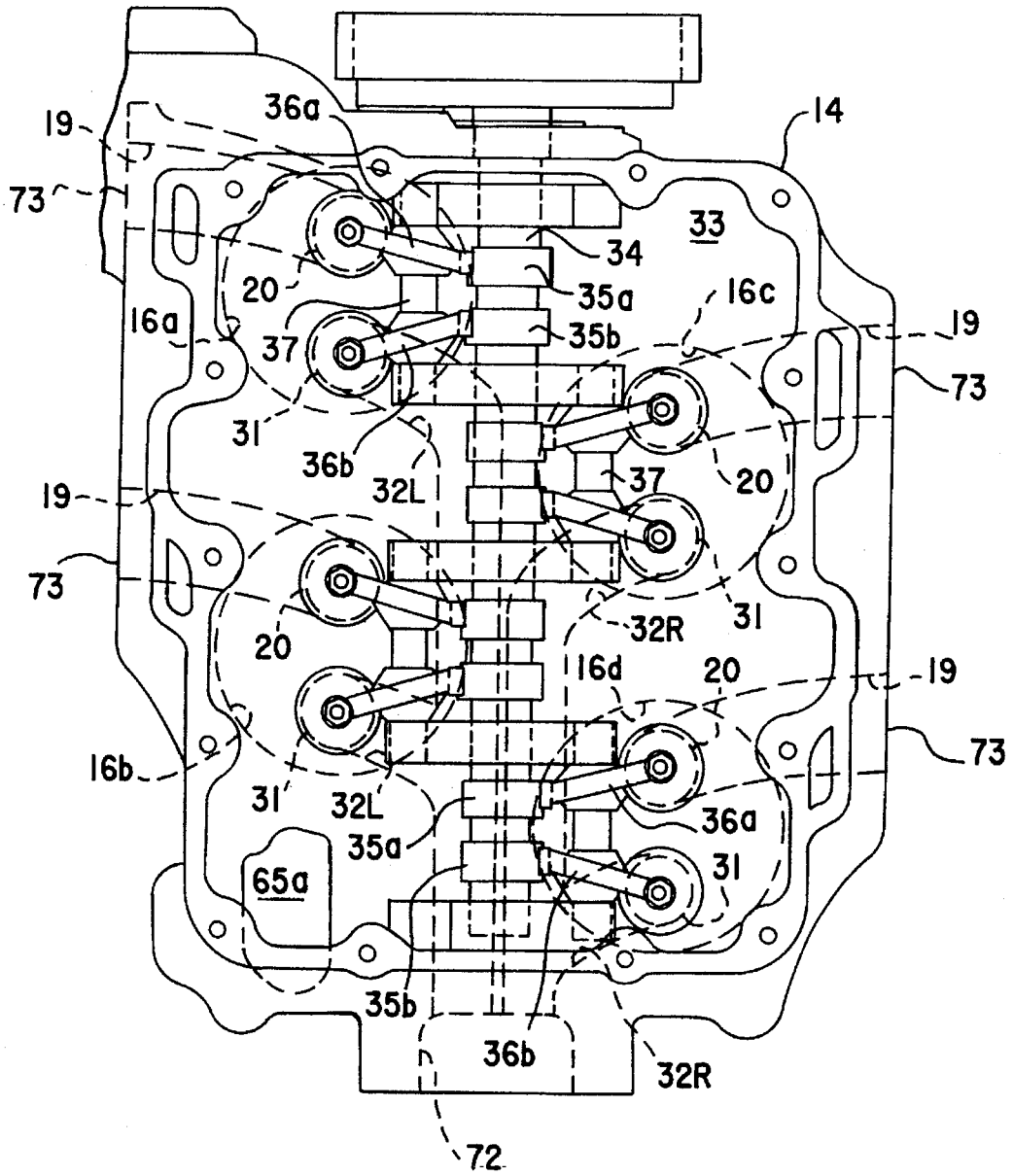
FIG. 6 is an end view of the cylinder head taken on the side of a cylinder head cover.

As shown in FIG. 6, (in FIG. 4, for the upper cylinder 16*c*) exhaust valves 31 are mounted below the intake valves 20 for the cylinders 16*a* to 16*d*, respectively, and exhaust passages 32R and 32L are defined in the cylinder head 14. The exhaust passages 32R are connected to the exhaust valve 31 for the right cylinders 16*c* and 16*d*, and the exhaust passages 32L are connected to the exhaust valves 31 for the left cylinders 16*a* and 16*b*. The exhaust passages 32L and 32R adjoin with each other through a partition wall 71 and in this state, they extend vertically through a widthwise central portion of the cylinder head 14, i.e., through an area between the array of the left cylinders 16*a* and 16*b* and the array of the right cylinders 16*c* and 16*d*, and are joined at then lower end to open as opening 72 in the lower surface of the cylinder head 14. The intake passages 19 open through openings 73 into the laterally opposite sides of the cylinder head 14, respectively (FIG. 6).

Further, a water jacket 74 is formed around the exhaust passages 32L and 32R to surround these exhaust passages, so that exhaust gas is effectively cooled by cooling water flowing through the water jacket 74.

A valve operating chamber 33 is formed in the cylinder head 14 at its end face opposite from the cylinder block 13, and a valve operating mechanism for operating the intake and exhaust valves 20 and 31 is located in the valve operating chamber 33. More specifically, as shown in FIG. 6, a cam shaft 34 is disposed centrally in the valve operating chamber 33 to extend vertically. A rocker arm 36*a* for the intake valve 20 and a rocker arm 36*b* for the exhaust valve 31 are in engagement with cams 35*a* and 35*b* provided on the cam shaft 34. Reference numeral 37 is a rocker arm shaft.

The engine 1 is constructed such that the array of the cylinders 16*a* and 16*b* and the array of the cylinders 16*c* and 16*d* form a V-shape with each other and decrease the angle formed therebetween by defining the cylinders 16*a* to 16*d* within the single cylinder block 13. The exhaust passages 32L and 32R each have a simple shape and are centrally provided in the cylinder head 14. The intake passages 19 open into the opposite sides of the cylinder block 13 and are connected to the intake pipes 21*a*, 21*b*, 21*c* and 21*d*. Moreover, fuel is supplied into the intake passages 19 by the fuel injection nozzle 26. Ignition plugs 27 are disposed accordingly. Therefore, the entire engine and particularly, the structure around the cylinder block 13 and the cylinder head 14 is reduced in size and simplified.

In addition, the intake passages 19 and the exhaust passages 32L and 32R are disposed in a substantially lateral, symmetric and balanced arrangement in the cylinder head 14, and the lengths of the passages for the left and right cylinder arrays are approximately equal to each other. Therefore, the flow of the intake and exhaust gases are equalized for each of cylinders 16*a* to 16*d*, leading to enhanced performance of the engine.

Figure 7:
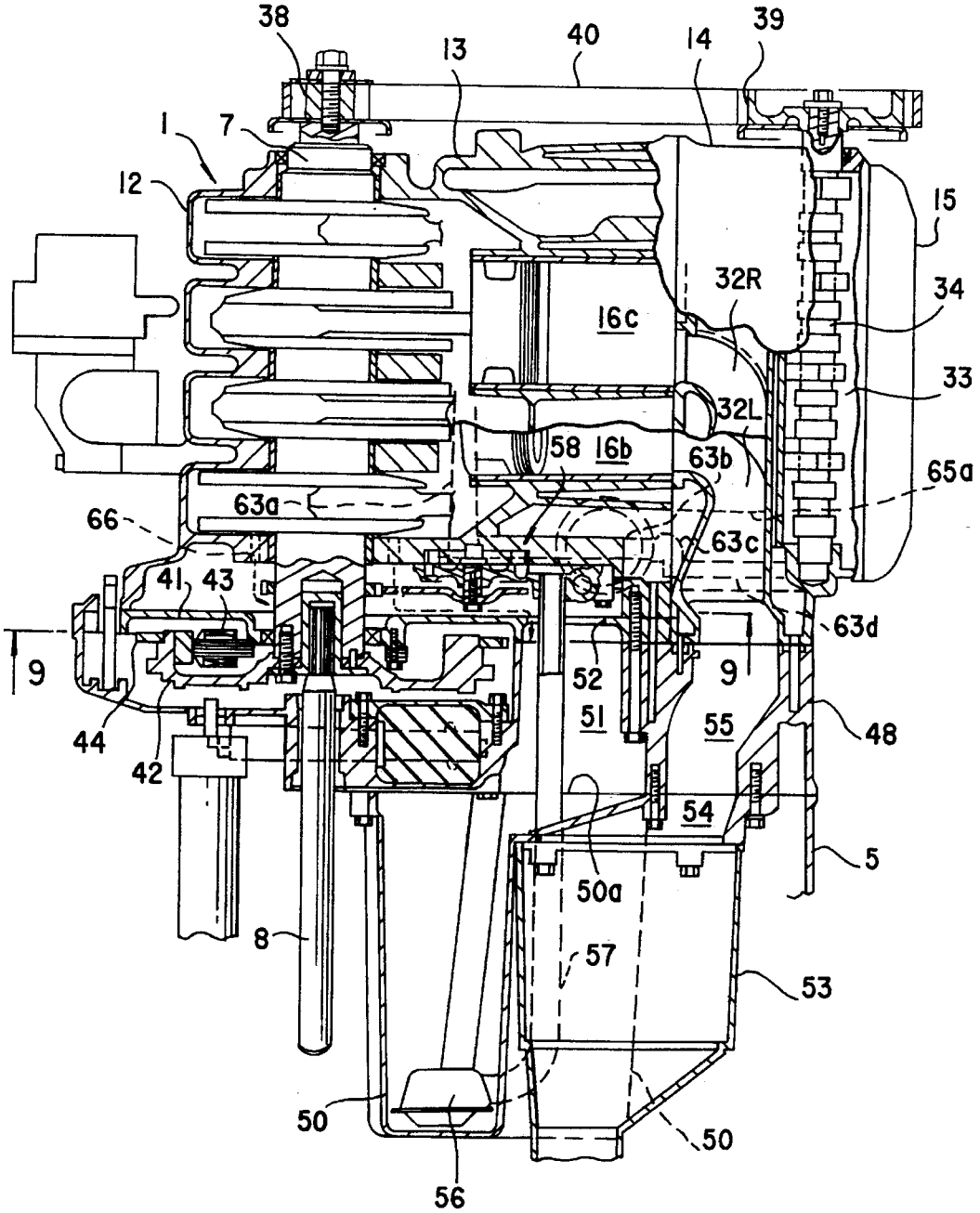
FIG. 7 is a vertical sectional view of the engine taken in various sections including an axis of a crankshaft.

FIG. 7 is a vertical sectional view of the engine 1 taken in various sections including an axis of the crankshaft 7, and a section of the cylinder 16*c* and a section of the cylinder 16*b* are partially shown.

The crankshaft 7 is orientcd vertically, as described above, and the cam shaft 34 is disposed parallel to the crankshaft 7 in the valve operating chamber 33 in the cylinder head 14. The crankshaft 7 and the cam shaft 34 project upwardly through the engine body and having pulleys 38 and 39 fixedly mounted at the upper ends of crankshaft 7 and cam shaft 34, respectively. A belt 40 is received around the pulleys 38 and 39. Thus, the cam shaft 34 is driven by the crankshaft 7 through the belt 40.

Lower surfaces of the cylinder block 13 and the crankcase 12 are opened, with a lower wall being formed by a closing plate 41 for sealingly closing the open portions. A lower end of the crankshaft 7 rotatably projects downwardly through the closing plate 41, and a flywheel 42 is secured to the lower end. The flywheel 42 has a circular dish-like configuration, and a dynamo 43 is incorporated in the flywheel 42. Further, a ring gear 44 is integrally formed around an outer periphery of the flywheel 42.

As shown in FIG. 2, a starter motor 45 is mounted on a right area of the cylinder block 13 and an output shaft 46 of the motor 45 projects downward. A driving gear 47 is mounted on the output shaft 46 and meshes with the ring gear 44. When the engine starts, the crankshaft 7 is driven by the starter motor 45.

Since the surge tanks 22L and 22R are reduced in size and the intake pipes 21*a* to 21*d* are disposed in the upper area as described above, the starter motor 45 is disposed in a space formed on the lower right side below the engine body. The starter motor 45 is disposed at a location substantially above the flywheel 42, so that the output shaft 46 of the motor 45 extends downward from the motor body into an engine mount case 48. The driving gear 47 mounted on the output shaft 46 meshes with the ring gear 44 provided around the outer periphery of the flywheel 42.

In the engine 1, the intake pipes 21*a* to 21*d* corresponding to the cylinders 16*a* to 16*d* are located on laterally opposite sides of the engine body, i.e., the intake pipes 21*a* and 21*b* are located on one side and the intake pipes 21*c* and 21*d* are located on the other side. Therefore, it is easy to position the intake pipes 21*a* to 21*d* and to equalize the effective lengths thereof.

The surge tanks 22L and 22R are also located laterally and are of a small size. Therefore, spaces for placement of the auxiliaries are available on the laterally opposite sides of the engine body. Further, the fuel supply system including the gas-liquid separator, and the oil filter 64 are placed in the space available on the left side, while the starter motor 45 is placed in the space available on the right side, thereby providing a good balance. Since the intake pipes 21*a* to 21*d* are disposed on the left and right sides of the engine body, and since the oil filter 64 is disposed in the space below the left side intake pipes 21*a* and 21*b*, it is possible to utilize the space at the side portion of the engine body to make the engine 1 compact. The location of the auxiliaries is not limited to the above-described locations, and the auxiliaries can be placed in any suitable location by utilizing the spaces available on the opposite sides.

Further, since air is supplied through the common throttle body 23 to the surge tanks 22L and 22R, it is not necessary to provide throttle valves in the surge tanks 22L and 22R, respectively. Therefore, each of the surge tanks 22L and 22R is further reduced in size and simplified in structure, leading to a reduced cost. Moreover, since the throttle body 23 is mounted on the lateral center line of the engine, the intake devices are substantially laterally symmetric. Further, the auxiliaries are also substantially laterally symmetric with good balance. Therefore, the engine according to the present invention has a good, balanced configuration with good weight distribution as a whole. The engine is especially suitable to be in a localized place such as the engine compartment in the upper area in the outboard engine structure.

The engine mount case 48 is coupled to the lower surfaces of the cylinder block 13 and the crankcase 12 by fastening it to the closing plate 41 using bolts 49 (FIGS. 2 and 3). The engine 1 is mounted on the motor case 5 through the engine mount case 48. The engine mount case 48 further extends rearwardly and is also coupled to the lower surface of the cylinder head 14 into which the exhaust passages 32L and 32R open.

Inside the motor case 5, an oil pan 50 is fastened at its upper end peripheral edge to the lower surface of the engine mount case 48. The oil pan 50 has an opening 50*a* in its upper surface. The opening 50*a* is in communication with the interior of the cylinder block 13 and the crankcase 12 through an oil communication passage 51 defined in the engine mount case 48 and an opening 52 provided in the closing plate 41. Oil accumulated on the closing plate 41 passes through the opening 52 and the oil communication passage 51 and drops from the opening 50*a* into the oil pan 50. An exhaust passage 54 is defined in a partitioned manner in the oil pan 50 to communicate with a catalytic converter 53 juxtaposed outside the oil pan 50. The exhaust passage 54 is also in communication with the exhaust passages 32L and 32R in the cylinder head 14 through an exhaust passage 55 defined in the engine mount case 48.

The oil stored in the oil pan 50 is drawn through a strainer 56 and an intake pipe 57 into an oil pump 58, and supplied from the oil pump 58 to various portions of the engine.

Figure 8:
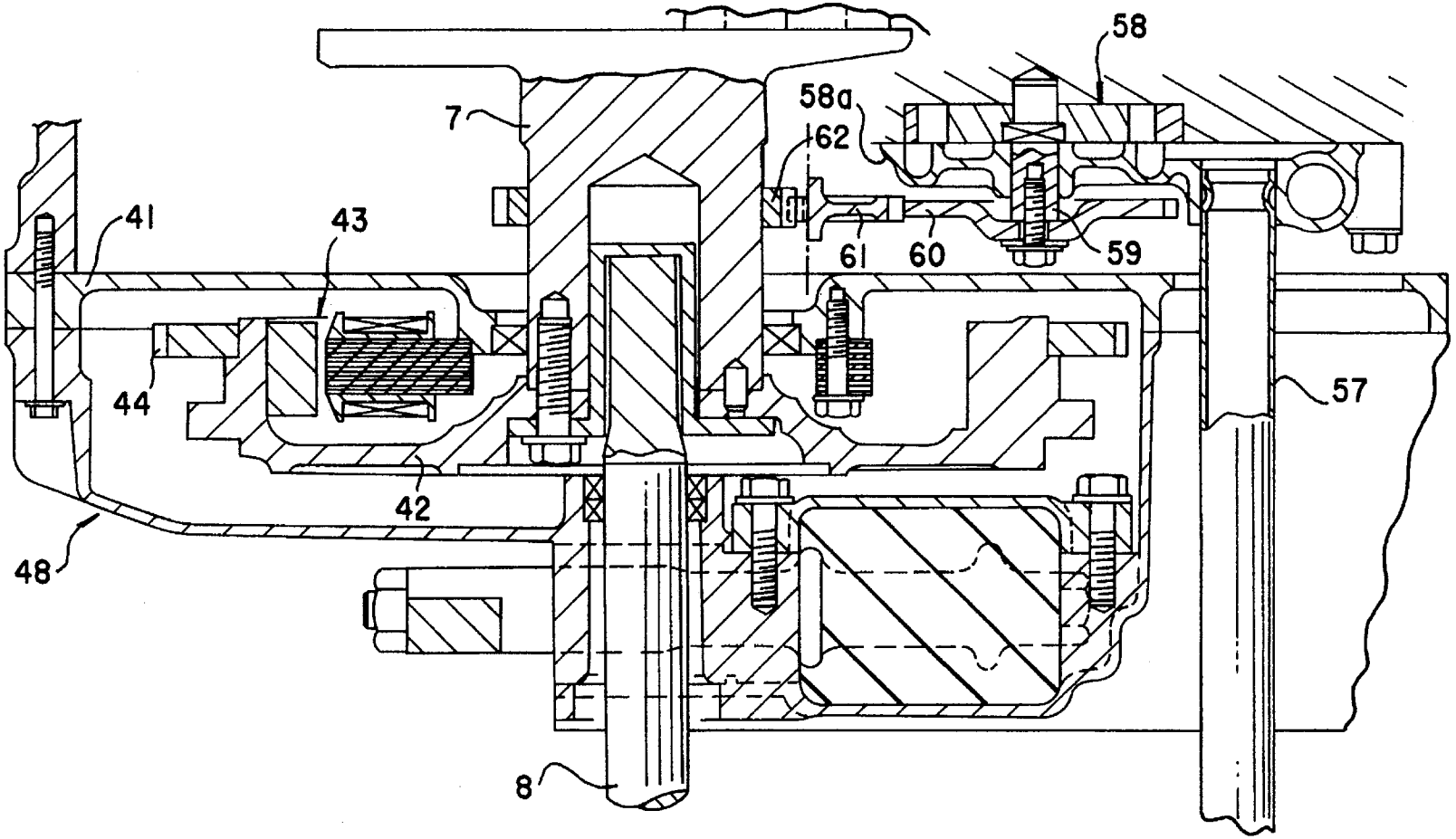
FIG. 8 is an enlarged view of a portion shown in FIG. 7.
Figure 9:
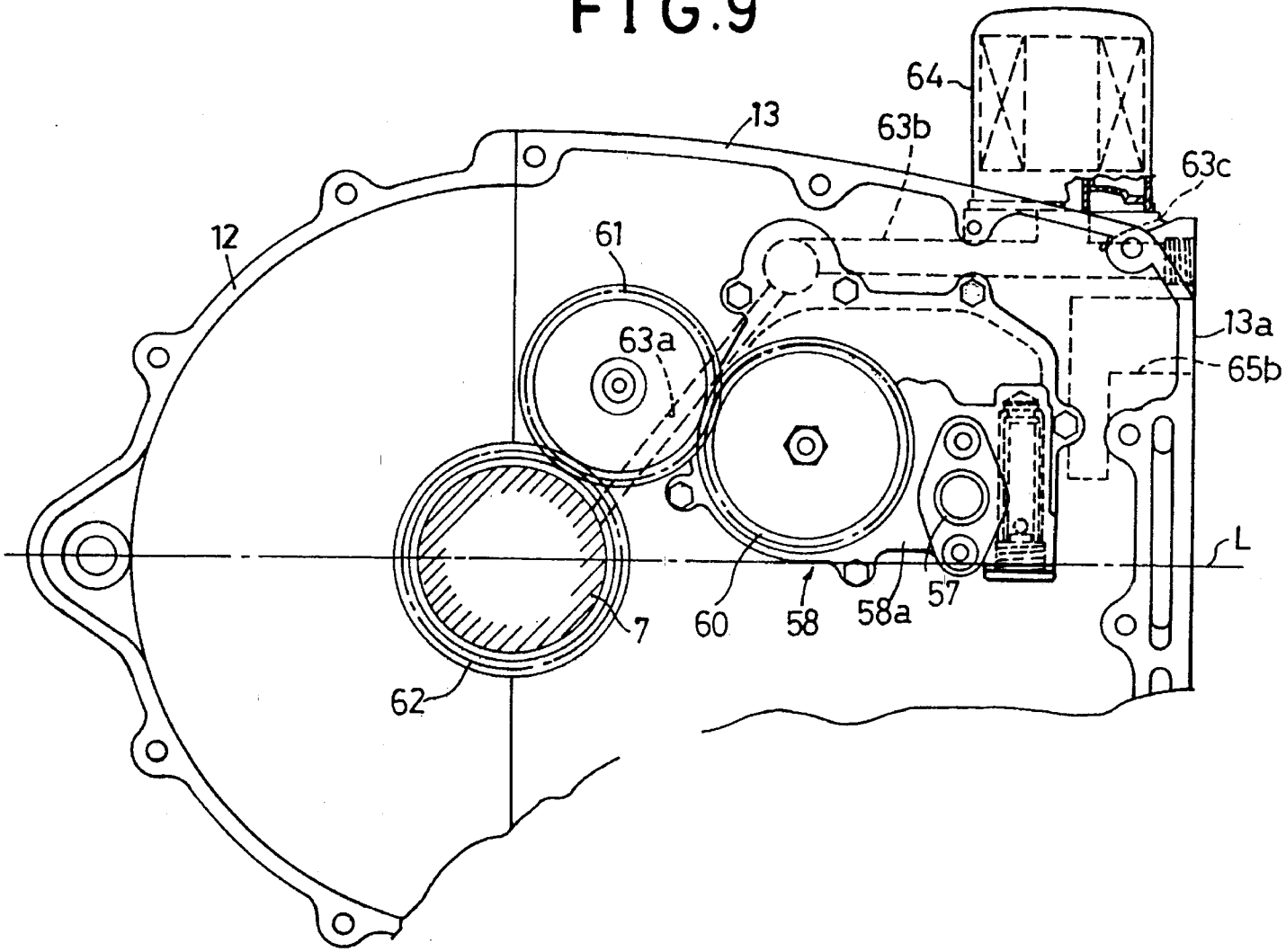
FIG. 9 is a bottom view of essential portions of the cylinder block and a crankcase taken along a line 9—9 in FIG. 7.

As can be seen from FIGS. 8 and 9, the oil pump 58 is mounted in the cylinder block 13 at a lower and left location close to the longitudinal center line L. This location corresponds to a position below the cylinder 16*b*. More specifically, as shown in FIG. 5, the left cylinders 16*a* and 16*b* are disposed at a level higher than the right cylinders 16*c* and 16*d*. Therefore, a space is created below the cylinder 16*b* and hence, the oil pump 58 is disposed in this space.

The oil pump 58 has a rotor shaft 59 which rotatably projects downwardly through a pump casing 58*a*. A driven gear 60 is fixedly mounted at a lower end of the rotor shaft 59. This driven gear 60 meshes with an intermediate gear 61 which meshes with a driving gear 62 fixedly mounted on the crankshaft 7. Thus, the oil pump 58 is driven by the crankshaft 7 through the train of the gears 62, 61 and 60.

The oil discharged from the oil pump 58 passes through an oil passage 63*a* to a main bearing of the crankshaft 7 and also through an oil passage 63*b* to the oil filter 64. The oil filter 64 is positioned to project from the left side of the cylinder block 13 at a location to the rear of the gas-liquid separator 28. The oil passage 63*b* leads to an oil passage 63*c* through the oil filter 64, and the oil passage 63*c* opens into the end face 13*b* of the cylinder block 13 adjacent the cylinder head 14 (FIG. 5).

An oil passage 63*d* is defined in the cylinder head 14, as shown in FIG. 7. The oil passage 63*d* is connected to the oil passage 63*c* in a mating face with the cylinder block and extends to the valve operating chamber 33. Thus, the oil leaving the oil passage 63*c* passes through the oil passage 63*d* into the valve operating chamber 33 and through oil passages properly located in the chamber to lubricate required portions to be lubricated, and is then discharged into the valve operating chamber 33.

An oil return passage 65*a* is also provided in the cylinder head 14 for carrying the oil discharged into the valve operating chamber 33 toward the cylinder block 13. The oil return passage 65*a* opens into the mating face of the cylinder head 14 with the cylinder block (FIGS. 6 and 7). An oil return passage 65*b* also opens into the end face 13*b* of the cylinder block 13 with the same profile as the oil return passage 65*a* (FIG. 5). Therefore, when the cylinder block 13 and the cylinder head 14 are coupled to each other, the oil return passages 65*a* and 65*b* are interconnected. The oil return passages 65*a* and 65*b* are disposed in a space created inwardly of the oil passages 63*d* and 63*c*, i.e., below the cylinder 16*b* adjacent the oil passages 63*d* and 63*c*, and are increased in cross-sectional area by effectively utilizing such space.

The oil return passage 65*b* is bent inwardly in the cylinder block 13, as shown in FIG. 9, and opens towards the opening 52 at a location just above the opening 52 (FIG. 7). The oil in a crank chamber is returned through an oil return hole 66 provided in the crankcase 12 and the opening 52 into the oil pan 50, as shown by a dotted line in FIG. 7.

In the present embodiment, one array of cylinders 16*a* and 16*b* is positioned in a higher level than the other array of the cylinders 16*c* and 16*d* to reduce the size of the engine body, and the oil pump 58 is located in the space created below the cylinder 16*b* which is disposed at the higher level. Therefore, the entire engine is small in size and compact.

In addition, since the oil return passages 65*a* and 65*b* are located in the above-described space and sufficiently increased in sectional area, oil lubrication is performed smoothly, leading to an enhanced lubricating performance.

The present invention may be embodied in other specific forms without departing from the spirit and essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. An engine comprising:

(a) a cylinder block having a plurality of cylinders formed in a V-shaped configuration, each of said cylinders having a piston therein;

(b) a cylinder head mounted on said cylinder block;

(c) exhaust passages formed in said cylinder head, said exhaust passages being located in a space formed by inner sides of said V-shaped configuration so as to be at a central portion of said V-shaped configuration, said exhaust passages opening into said cylinders;

(d) intake passages formed in said cylinder head, so as to open at one ends thereof to opposite outer sides of said cylinder head on opposite sides of said V-shaped configuration and at other ends into said cylinders respectively;

(e) fuel injection nozzles provided in said intake passages; and (f) a crankshaft operatively coupled to said pistons and oriented perpendicular to the axes of said cylinders.

2. An engine according to claim 1, wherein said exhaust passages extend parallel to said crankshaft within said cylinder head and open into a corresponding side surface of the cylinder head.

3. An engine according to claim 1 or 2, further including a water jacket in said cylinder head, said water jacket surrounding said exhaust passages.

4. An engine according to claim 1, wherein an ignition plug is disposed on said lateral opposite outer side of the cylinder head at a location closer to the cylinder block than the associated fuel injection nozzle.

5. An engine comprising:

(a) an engine body having a plurality of cylinders therein;

(b) a cylinder head mounted on one end of said engine body;

(c) a crankcase mounted on an other end of said engine body;

(d) a plurality of intake pipes communicating with said cylinders, said intake pipes being divided into two groups, one group of the intake pipes extending from one of opposite sides of said cylinder head and along a first side surface of said engine body toward said crankcase, and another group of said intake pipes extending from the other side of said cylinder head and along an opposite side surface of said engine body toward the crankcase;

(e) a first surge tank mounted on one side of said crankcase and a second surge tank mounted on the other side of said crankcase;

(f) wherein said one group of said intake pipes is connected to said first surge tank and said another group of said intake pipes is connected to said second surge tank; and (g) throttle means disposed outside of said crankcase and coupled to said first and second surge tanks for controlling the flow of air into said surge tanks.

6. An engine according to claim 5, wherein said intake pipes around said engine body are disposed at one side of the engine body in an axial direction of the crankshaft, and at least one auxiliary device mounted on an opposite side of said engine body in the axial direction of the crankshaft.

7. An engine according to claim 6, wherein said auxiliary device comprises a starter motor is mounted on one of the side surfaces of said engine body and a fuel supply system is mounted on the other of the side of said engine body.

8. An engine according to claim 6, wherein said auxiliary device includes a starter motor mounted on one side of said engine body and a fuel supply system mounted on the opposite side of said engine body.

9. An engine according to claim 5, further including at least one auxiliary means mounted on the side of the engine body below a location of said intake pipes.

10. An engine comprising:

(a) a cylinder block having two groups of horizontally oriented cylinders, said two groups of cylinders configured to form a V-shape, wherein one group is offset toward a higher side;

(b) oil pump means mounted on said cylinder block and positioned beneath said higher group of cylinders;

(c) a crankshaft disposed vertically; and (d) a power transmission belt associated with said crankshaft at one axial end portion of the crankshaft, said oil pump means being driven by said crankshaft at a location near the other axial end portion of the crankshaft.

11. An engine according to claim 10 further including a single cylinder head mounted on said cylinder block, said cylinder head having a valve operating chamber, wherein an oil return passage is located below said higher group of cylinders, for returning oil from said valve operating chamber to said cylinder block.

12. A four cycle engine comprising:

(a) a cylinder block;

(b) a plurality of cylinders located in said cylinder block, said cylinders being horizontally oriented and configured in a V-shape configuration;

(c) a vertically oriented crankshaft mounted on said cylinder block;

(d) a plurality of intake pipes divided into two groups which extend along respective opposite side portions of said cylinder block; and (e) an oil filter mounted on one of said opposite side portions of said cylinder block.

13. An engine according to claim 12, wherein said oil filter is mounted below said intake pipes.

14. An outboard engine structure having an engine, said engine comprising:

(a) a cylinder block;

(b) a plurality of horizontally oriented cylinders formed in said cylinder block, said cylinders being in a V-shape configuration;

(c) a single cylinder head, common to all of said cylinders, mounted on said cylinder block;

(d) a plurality of exhaust passages formed in said cylinder head at a location corresponding to inner sides of said V-shaped configuration so as to lie at a central portion of the V, said exhaust passages communicating with said cylinders;

(e) a plurality of intake passages formed in outer sides of said cylinder head and opening to lateral opposite outer sides of the cylinder head, corresponding to outer sides of the V, said intake passages communicating with said cylinders; and (f) a fuel injection nozzle located in each of said plurality of intake passages.

15. An outboard engine structure having a four cycle engine, said engine comprising:

(a) a cylinder block;

(b) a crankshaft vertically mounted in said cylinder block;

(c) a plurality of horizontally oriented cylinders disposed in said cylinder block in a V-shaped configuration;

(d) intake pipes mounted on said cylinder block, said intake pipes being divided into two groups extending horizontally along opposite side portions of said cylinder block; and (e) oil filter means mounted on said cylinder block on one of said opposite side portions of the cylinder block.

16. An engine comprising:

(a) an engine body having a plurality of cylinders therein;

(b) a cylinder head mounted on one end of said engine body;

(c) a crankcase mounted on the other end of said engine body;

(d) a plurality of intake pipes communicating with said cylinders, at least one of said intake pipes extending from a side of said cylinder head and along a first side surface of said engine body toward said crankcase, and at least one other of said intake pipes extending from a side of said cylinder head and along an opposite side surface of said engine body;

(e) a first surge tank mounted on one side of said crankcase and a second surge tank mounted on the other side of said crankcase;

(f) wherein said at least one of said plurality of intake pipes is connected to said first surge tank and said at least one other of said plurality of intake pipes is connected to said second surge tank; and (g) throttle means coupled to said first and second surge tanks for controlling the flow of air into said surge tanks.

17. An engine comprising:

(a) a cylinder block having two groups of horizontally oriented cylinders, said two groups of cylinders configured to form a V-shape, wherein one group is higher than the other group;

(b) oil pump means mounted on said cylinder block and positioned beneath said higher group of cylinders;

(c) including a single cylinder head mounted on said cylinder block, said cylinder head having a valve operating chamber and an oil return passage, wherein said oil return passage is located below said higher group of cylinders, said oil return passage returning oil from said valve operating chamber to said cylinder block;

(d) a cylinder block having two groups of horizontally oriented cylinders, said two groups of cylinders configured to form a V-shape, wherein one group is higher than the other group; and (e) oil pump means mounted on said cylinder block and positioned beneath said higher group of cylinders.

* * * * *